US010751893B2

(12) United States Patent
Okura et al.

(10) Patent No.: US 10,751,893 B2
(45) Date of Patent: Aug. 25, 2020

(54) OUTER BLADE FOR HAIR CUTTING DEVICE AND HAIR CUTTING DEVICE

(71) Applicant: PANASONIC INTELLECTUAL PROPERTY MANAGEMENT CO., LTD., Osaka (JP)

(72) Inventors: Shoki Okura, Shiga (JP); Hiroaki Shimizu, Shiga (JP); Shintaro Matsuo, Shiga (JP); Shigetoshi Sakon, Osaka (JP); Hiroki Inoue, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 159 days.

(21) Appl. No.: 15/891,046

(22) Filed: Feb. 7, 2018

(65) Prior Publication Data

US 2018/0243931 A1 Aug. 30, 2018

(30) Foreign Application Priority Data

Feb. 24, 2017 (JP) ..... 2017-034087

(51) Int. Cl.
*B26B 19/14* (2006.01)
*B26B 19/40* (2006.01)
(Continued)

(52) U.S. Cl.
CPC ..... *B26B 19/40* (2013.01); *B26B 19/143* (2013.01); *B26B 19/3846* (2013.01); *B26B 19/42* (2013.01)

(58) Field of Classification Search
CPC ... B26B 19/143; B26B 19/3846; B26B 19/40; B26B 19/42
See application file for complete search history.

(56) References Cited

U.S. PATENT DOCUMENTS

2005/0274019 A1 12/2005 Inoue et al.
2011/0232098 A1 9/2011 Kobayashi et al.
2012/0317815 A1* 12/2012 Shimizu ..... B26B 19/384 30/34.2

FOREIGN PATENT DOCUMENTS

EP 1354675 A1 10/2003
JP 2000-237473 A 9/2000
(Continued)

OTHER PUBLICATIONS

The Extended European Search Report dated Jul. 12, 2018 for the related European Patent Application No. 18155953.5.

*Primary Examiner* — Stephen Choi
(74) *Attorney, Agent, or Firm* — McDermott Will & Emery LLP

(57) ABSTRACT

An outer blade for a hair cutting device, the outer blade being mounted to an end of a main body of the hair cutting device, includes bars that each have a shape of a rectangular stick and are arranged at predetermined intervals. The outer blade also includes, at a skin-surface-contact-side first face of each of the bars, an agent holding part configured to hold an agent that is a substance having a predetermined effect on a skin surface, the agent holding part being a surrounded recess heading from the skin-surface-contact-side first face of the bar toward an inner-blade-side second face of the bar. Thus, the agent such as foam or gel can be held by the agent holding part at the skin-surface-side face of the outer blade, and friction can be reduced between the outer blade and the skin surface by the agent held by the agent holding part.

8 Claims, 6 Drawing Sheets

(51) Int. Cl.
*B26B 19/42* (2006.01)
*B26B 19/38* (2006.01)

(56) References Cited

FOREIGN PATENT DOCUMENTS

| | | | |
|---|---|---|---|
| JP | 2002-102552 | A | 4/2002 |
| JP | 4140558 | B2 | 8/2008 |
| JP | 2011-200552 | A | 10/2011 |
| WO | 2007/037247 | A1 | 4/2007 |

* cited by examiner

OUTER BLADE FOR HAIR CUTTING DEVICE AND HAIR CUTTING DEVICE

BACKGROUND

1. Technical Field

The present disclosure relates to an outer blade for a hair cutting device such as an electric shaver and also relates to a hair cutting device including the outer blade.

2. Description of the Related Art

As shown in Japanese Patent No. 4,140,558, a hair cutting device structurally includes, in a main body, a power supply unit such as a battery, and a drive unit such as a motor, and has an end mounted with a blade block that is formed of inner blades and outer blades. The main body is gripped, and the outer blades are slid while being pressed against a skin surface, whereby a beard introduced into blade holes of the outer blades is cut by the inner blades.

SUMMARY

With this type of hair cutting device, friction is caused between the skin surface and the outer blades that are slid while being pressed against the skin surface, so that a challenge is how to achieve smooth shaving.

The present disclosure provides an outer blade that is used in a hair cutting device and enables smooth hair shaving and also provides a hair cutting device.

The outer blade included in the present disclosure is used in a hair cutting device and is mounted to an end of a main body of the hair cutting device. This outer blade includes bars arranged at predetermined intervals, each of the bars having a shape of a rectangular stick, and an agent holding part being a surrounded recess that is recessed from a first face to a second face of each of the bars, the first face being a side that comes into contact with a skin surface, and the second face being a side that is closer to an inner blade of the hair.

The hair cutting device also included in the present disclosure includes an outer blade including: bars arranged at predetermined intervals, each of the bars having a shape of a rectangular stick, and an agent holding part being a surrounded recess that is recessed from a first face to a second face of each of the bars, the first face being a side that comes into contact with a skin surface, and the second face being a side that is closer to an inner blade of the hair. The hair cutting device also includes an inner blade that moves relatively to the outer blade, the inner blade being disposed inwardly of the outer blade, and a main body that holds the outer blade and the inner blade.

According to the present disclosure, the agent holding part is provided in the part of the outer blade which makes contact with a skin surface, so that the held agent such as water or shaving cream can be allowed to seep between the skin surface and the outer blade in use, thus achieving satisfactory sliding of the outer blade on the skin surface. In this way, smooth shaving or the like is enabled.

DETAILED DESCRIPTION

Exemplary Embodiments

With reference to the drawings, a description is provided next of exemplary embodiments of an outer blade for a hair cutting device and a hair cutting device according to the present disclosure. It is to be noted that the following exemplary embodiments merely exemplify the outer blade for the hair cutting device and the hair cutting device of the present disclosure. Therefore, the scope of the present disclosure is defined by the recitation in the claims with reference to the following exemplary embodiments, and the present disclosure is not limited only to the following exemplary embodiments. Thus, among constituent elements in the following exemplary embodiments, constituent elements not recited in any one of the independent claims that indicate the most generic concepts of the present disclosure are not necessarily essential for achievement of the object of the present disclosure but are described for the preferred embodiments.

The drawings are schematic views in which emphasis, omission, and proportion adjustment are made as required for illustration of the present disclosure and may have shapes, positional relationships and proportions that differ from actual shapes, actual positional relationships, and actual proportions.

First Exemplary Embodiment

[Hair Cutting Device]

Figure 1:
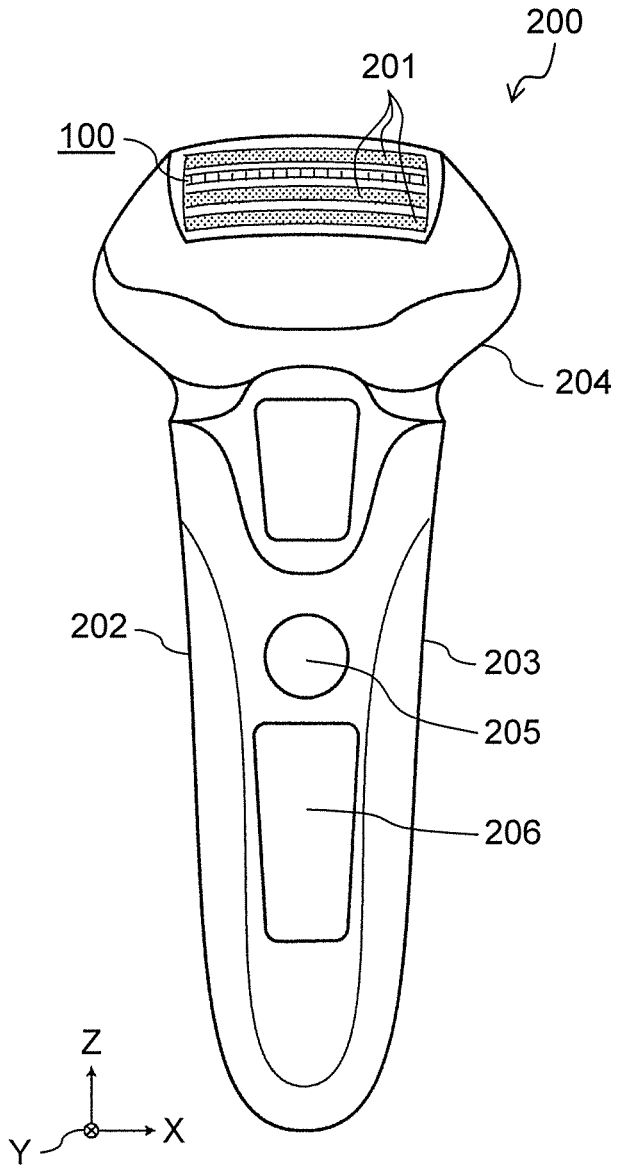
FIG. 1 is a front view of a hair cutting device according to a first exemplary embodiment.

FIG. 1 is a front view of hair cutting device 200 according to the first exemplary embodiment.

Figure 2:
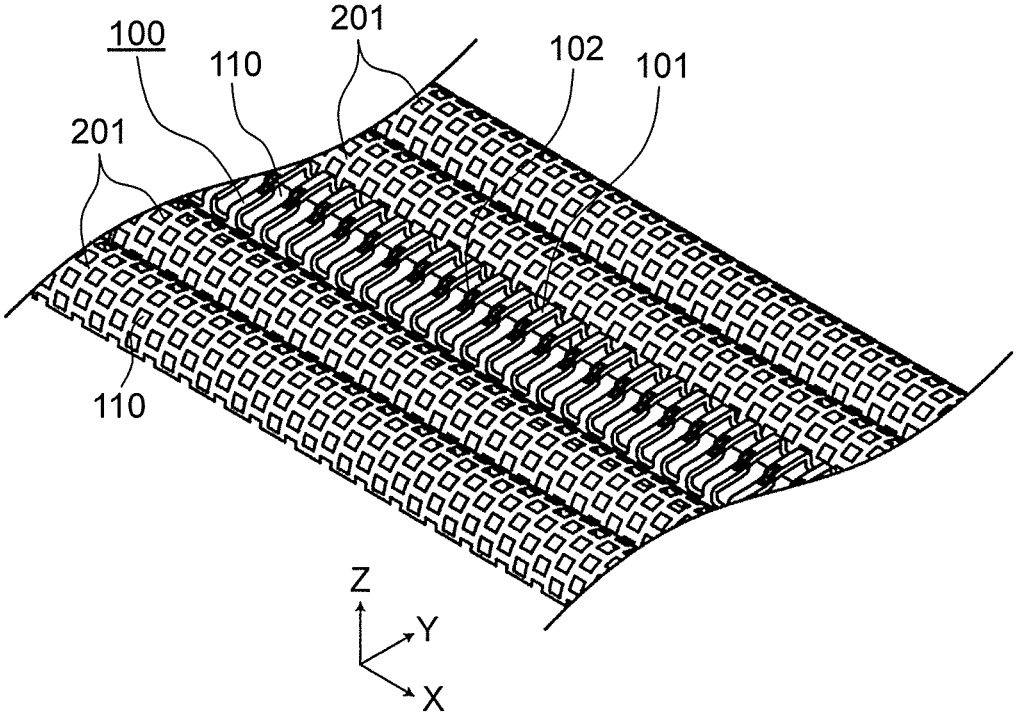
FIG. 2 is a perspective view illustrating arrangement of fixed blades of the hair cutting device according to the first exemplary embodiment.

FIG. 2 is a perspective view illustrating arrangement of fixed blades of hair cutting device 200 according to the first exemplary embodiment.

As shown in the figure, hair cutting device 200 according to the present exemplary embodiment is a so-called electric shaver. With main body 202 of hair cutting device 200 being gripped in one hand by a person, outer blade 100 and second outer blades 201 (may be hereinafter described generally as "fixed blades") are slid while being pressed against, for example, a facial skin surface, whereby this device cuts (shaves) beard, that is, hair. Hair cutting device 200 includes inner blades 210 (refer to FIG. 4) that respectively slide along respective inner faces of the fixed blades.

Main body 202 accommodates a drive unit (not shown) that drives inner blades 210, a power supply device (not shown) that supplies power to the drive unit, and a controller (not shown) that controls the drive unit and the power supply device. In the present exemplary embodiment, main body 202 is provided with, for example, power switch 205 and display 206 that displays a state of hair cutting device 200. Main body 202 also includes grip section 203 that is gripped in the hand by the user and head section 204 to which the fixed blades are detachably mounted. Head section 204 can be angled (swung) freely relative to grip section 203. A drive mechanism including the drive unit (not shown) that is accommodated in head section 204 is connected to inner blades 210, which are movable blades, so that inner blades 210 can reciprocate relative to the fixed blades, respectively. With inner blades 210 thus shifting relative to the respective fixed blades while making sliding contact with the respective inner faces of the fixed blades in hair cutting device 200, hairs inserted into blade holes 110 of the fixed blades are cut.

[Inner Blades]

At least one inner blade 210 is provided for each of the fixed blades. Inner blade 210 is a member that cuts hairs coming into blade holes 110 of the fixed blade by sliding on the inner face of the fixed blade. While a shape and a mode of operation of inner blade 210 are determined in association with the fixed blade and are not particularly limited, the shape of inner blade 210 in the present exemplary embodiment is such that a plurality of blades respectively conforming to inner face shapes of the fixed blade are arranged along an extending direction of the fixed blade (along an X-axis direction in the figure), and inner blade 210 operates, in the present exemplary embodiment, to reciprocate relative to the fixed blade along the extending direction of the fixed blade.

It is to be noted that inner blade 210 may be, for example, inner blade 210 of a rotating type in which a plurality of blades are disposed radially to rotate around an axis perpendicular to a face of, for example, outer blade 100 or inner blade 210 of a rotary type having a spiral blade that rotates around an axis parallel to the face of outer blade 100 or the like.

[Second Outer Blades]

Each of second outer blades 201 is a member that is thinner than outer blade 100 and is intended to cut hair shorter as compared with outer blade 100. In the present exemplary embodiment, second outer blade 201 is a so-called net blade that is a curved thin plate provided with many blade holes 110 and has a deep shaving function of shaving hair such as a short beard at its root. Second outer blade 201 does not include recess-shaped agent holding parts 102 (described later) that outer blade 100 includes. The plurality of second outer blades 201 (four in the present exemplary embodiment) are disposed parallel to the extending direction of outer blade 100 with outer blade 100 interposed among second outer blades 201.

Specifically, outer blade 100 is disposed in a middle of a direction perpendicular to the direction (the X-axis direction in the figure) along which inner blade 210 reciprocates, and second outer blades 201 are disposed on each side of this outer blade 100.

[Outer Blade]

Figure 3:
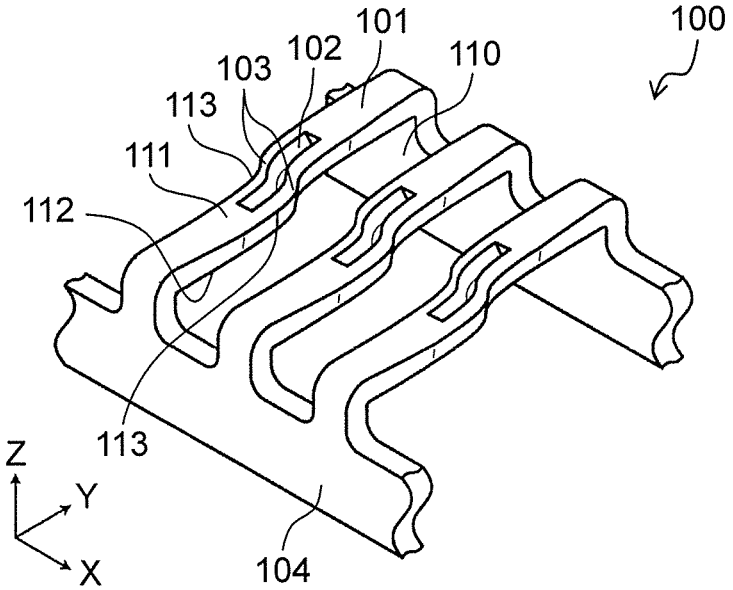
FIG. 3 is a perspective view illustrating a portion of an outer blade of the hair cutting device according to the first exemplary embodiment.

FIG. 3 is a perspective view illustrating a portion of outer blade 100.

As shown in the figure, outer blade 100 is a member that is mounted to an end of main body 202 of hair cutting device 200 and includes bars 101 and agent holding parts 102. In the present exemplary embodiment, outer blade 100 is intended to shave long hair that is difficult to shave with second outer blades 201 and is a so-called slit blade having slit-shaped blade holes 110 and bars 101 that are alternately arranged in parallel relationship.

While material for outer blade 100 is not particularly limited, an example of the material can be martensitic stainless steel. A thickness of outer blade 100 is also not limited; however, the thickness is set greater than a thickness of each of second outer blades 201. Specifically, in the case of martensitic stainless steel, for example, the thickness of outer blade 100 needs to be 0.1 mm or more, and preferably 0.2 mm or more. From the point of view of hair shaving, it is preferable that the thickness of outer blade 100 be not more than 0.7 mm.

Figure 4:
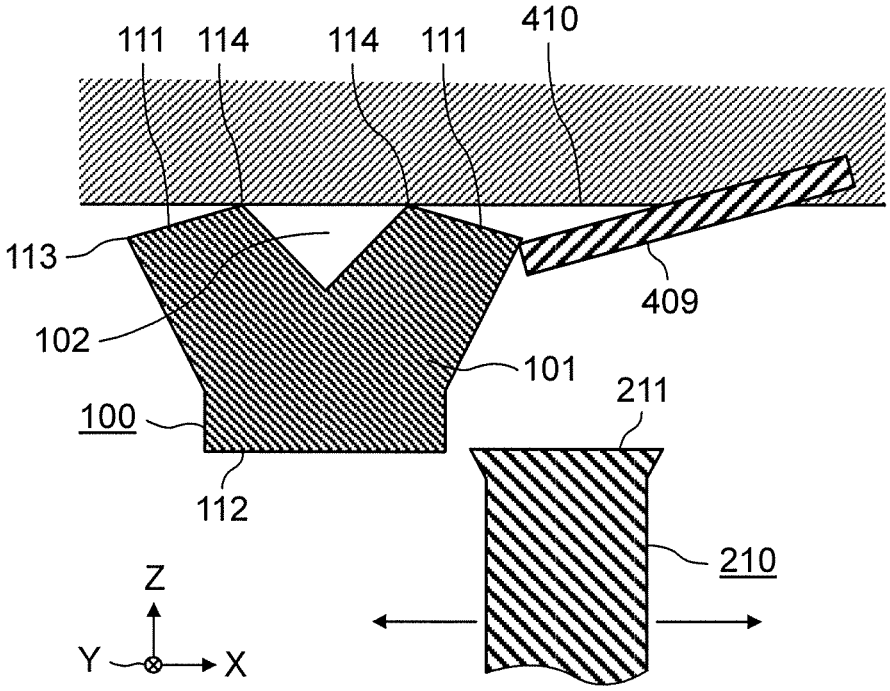
FIG. 4 is a sectional view illustrating respective sections of the outer blade and an inner blade of the hair cutting device as well as skin according to the first exemplary embodiment.

FIG. 4 is a sectional view illustrating respective sections of outer blade 100 and inner blade 210 as well as skin.

Bars 101 are parts each having the shape of a rectangular stick, are arranged at predetermined intervals, and cut hairs inserted into blade holes 110 in cooperation with inner blade 210 that slides relatively to outer blade 100. In the present exemplary embodiment, each of bars 101 is bent in the shape of a crank, including two bends 103. First face 111 that makes contact with skin surface 410 gradually slopes toward inner-blade-side second face 112, heading outward from intermediate part 114 along its width direction (the X-axis direction in the figure). Edges 113 of first face 111 project outwardly of second face 112 and are positioned closer to second face 112 than intermediate part 114 of first face 111.

With bar 101 having such a shape, edges 113 can raise hair 409 that has grown along skin surface 410 for introduction into blade hole 110 while preventing edges 113 from cutting into skin surface 410. Because of having a cranked shape, bar 101 can effectively raise hairs that have grown in various directions.

The plurality of bars 101 are integrally connected with strip-shaped frames 104 that are upright from a plane in which bars 101 are disposed. Frames 104 extend along an arrangement direction of bars 101.

[Agent Holding Parts]

Each of agent holding parts 102 is a surrounded recess heading from skin-surface-contact-side first face 111 toward inner-blade-side second face 112 of bar 101, and is a bottomed space that holds an agent that is a substance having a predetermined effect on a skin surface.

Here "surrounded" means that bar 101 surrounding an opening of agent holding part 102 has no gap or that agent holding part 102 disposed in a predetermined posture can continue holding liquid of high fluidity, such as water, without having any place where an outflow of the liquid takes place during storage. The agent held by agent holding part 102 is not particularly limited and also includes water. Specifically, examples of the agent include agents that reduce friction between outer blade 100 and skin surface 410, such as so-called shaving gel and so-called shaving foam, and agents each including a medicinal ingredient that moisturizes skin or prevents skin from becoming rough.

A number of agent holding parts 102 is not particularly limited. One bar 101 may be provided with one agent holding part 102 or may be provided with a plurality of agent holding parts 102. Bars 101 may each have agent holding part 102, or there may be bar 101 without agent holding part 102.

The shape of agent holding part 102 is not particularly limited, and a shape of choice such as a circular shape or a rectangular shape can be adopted for agent holding part 102.

In the present exemplary embodiment, bars 101 are each provided with one agent holding part 102 to be capable of holding a larger amount of agent. Agent holding part 102 extends longitudinally of bar 101 so as to straddle two adjacent bends 103 and is disposed at a projecting part of intermediate part 114 of first face 111. As such, one agent holding part 102 can hold a large amount of agent. Agent holding part 102 opens at the part that is pressed against skin surface 410, thus enabling effective use of the agent held by agent holding part 102. When viewed in a direction perpendicular to first face 111, agent holding part 102 has a cranked shape (in an X-Y plane in the figure) that runs along bar 101, thus enabling effective use of the agent held by agent holding part 102 even in cases where outer blade 100 is slid on skin surface 410 in a plurality of different directions. Agent holding part 102 has an area of second face 112 side smaller than an area of first face 111 side in a plane (X-Y plane in the figure) perpendicular to its depthwise direction (a Z-axis direction in the figure). Specifically, as shown in FIG. 4, agent holding part 102 has its width along a width direction of bar 101 (along the X-axis direction in the figure) that gradually decreases from first face 111 (the opening side) toward second face 112 (the bottom side). Structural strength can thus be ensured for bar 101 while a sufficient agent holding capacity is ensured.

[Example of Process]

Figure 5:
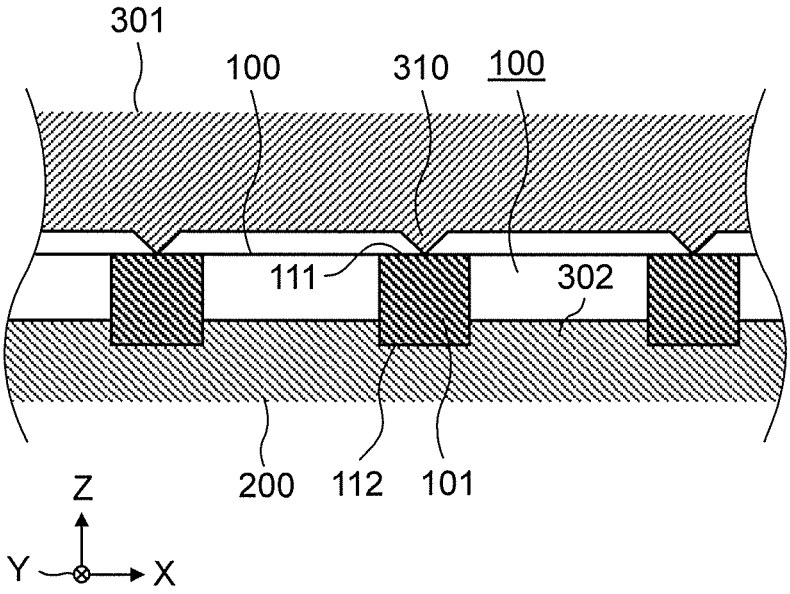
FIG. 5 illustrates a process of forming agent holding parts of the hair cutting device according to the first exemplary embodiment.

A process of forming agent holding parts 102 in bars 101 is not particularly limited. For example, as shown in FIG. 5, bars 101 each having the shape of the rectangular stick may be plastically deformed to be formed with agent holding parts 102 by being mounted on base 302 and undergoing punching using tool 301 that has pointed ends 310. Bar 101 may be formed with agent holding part 102 by having a portion removed by, for example, machining, laser beam machining, electrical discharge machining, or etching. Agent holding part 102 and bar 101 may be formed together by, for example, electroforming.

Second Exemplary Embodiment

A description is provided next of another exemplary embodiment of outer blade 100. It is to be noted that those (parts) having actions, functions, shapes, mechanisms, or structures that are similar to those in the first exemplary embodiment have the same reference marks, and their description may be omitted. The following description is centered on those different from the first exemplary embodiment, and description of the same contents as those of the first exemplary embodiment may be omitted.

Figure 6:
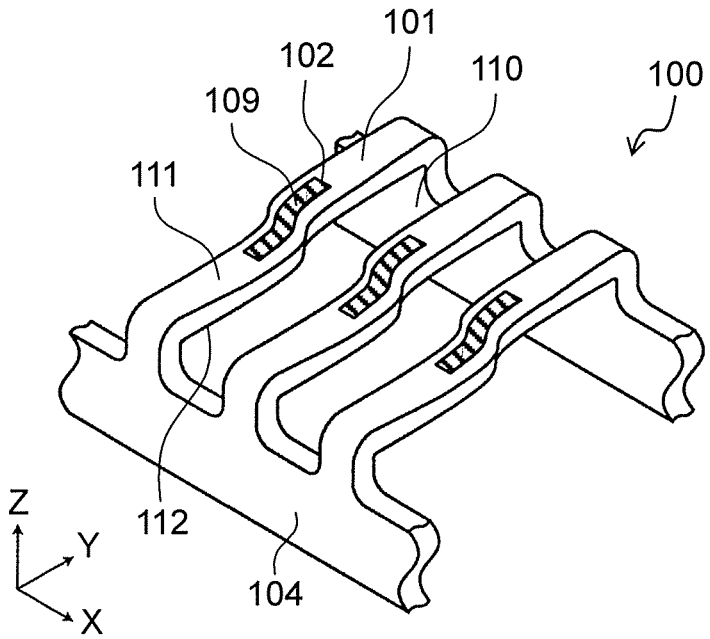
FIG. 6 is a perspective view illustrating an outer blade of a hair cutting device according to a second exemplary embodiment.

FIG. 6 is a perspective view illustrating outer blade 100 of hair cutting device 200 according to the second exemplary embodiment.

Figure 7:
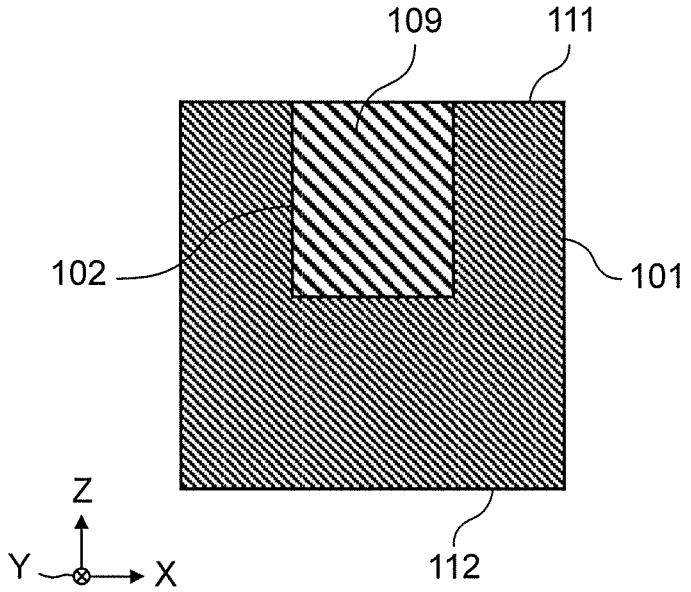
FIG. 7 is a sectional view of a bar having an agent holding part in the hair cutting device according to the second exemplary embodiment.

FIG. 7 is a sectional view of bar 101 having agent holding part 102 in hair cutting device 200 according to the second exemplary embodiment.

As shown in these figures, outer blade 100 includes an agent filled into agent holding part 102 of bar 101. In the present exemplary embodiment, agent holding part 102 has a width that is substantially uniform, heading from first face 111 toward second face 112 for the purpose of holding an increased amount of agent 109.

While agent 109 is not particularly limited, it is preferred that agent 109 is a substance that is solid when hair cutting device 200 is not in use (when hair cutting device 200 is left as is, for example, in an environment with a temperature of 20° C., a relative humidity of 65%, and an atmospheric pressure of 1013 hPa) but dissolves to come out of agent holding part 102 by contact with, for example, water. As such, agent 109 is solid in agent holding part 102 before and after use of outer blade 100, and thus does not fall from agent holding part 102 even in cases where hair cutting device 200 is carried. When hair cutting device 200 is used, agent 109 dissolves by merely applying water to skin surface 410, and thus can be effective in improving, for example, sliding of the fixed blade on skin. Here "solid" means that even when hair cutting device 200 is carried, agent 109 not absorbing water or the like does not come out of agent holding part 102, and not only implies that agent 109 is fully solidified in agent holding part 102 but also implies that agent 109 satisfies the requirement even, for example, in gelatinous or gelled form.

[Others]

The above exemplary embodiments are not restrictive of the present disclosure. For example, other exemplary embodiments that are realized by combining the constituent elements of choice that are described in this description or excluding some of the constituent elements may also be exemplary embodiments of the present disclosure. Also, modifications obtained by applying to the above exemplary embodiments various modifications that may be conceived of by those skilled in the art without departing from the spirit of the present disclosure, that is, meaning of the recitation in the claims are included in the present disclosure.

Figure 8:
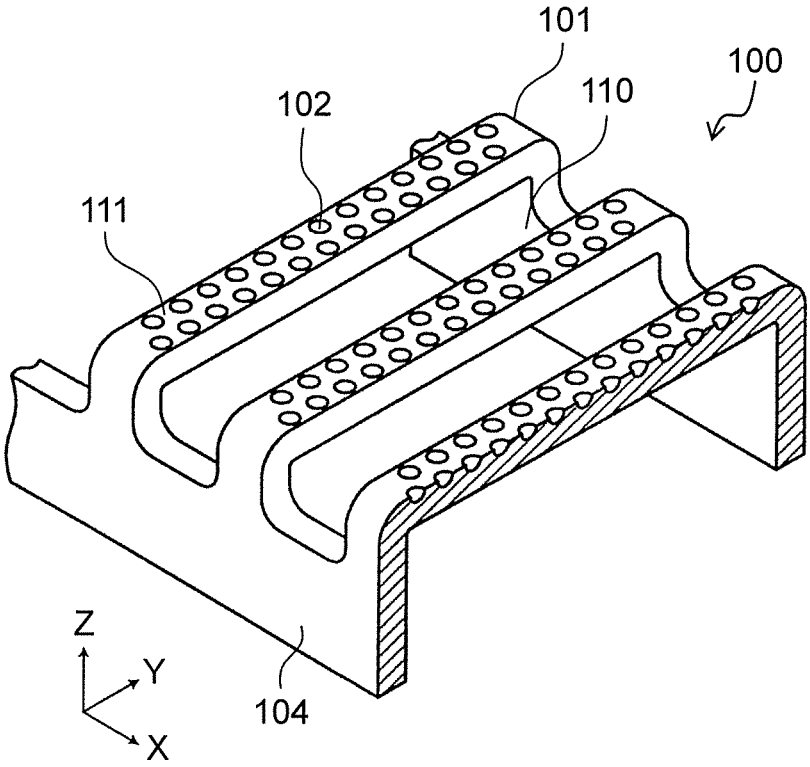
FIG. 8 is a perspective sectional view illustrating another example of the agent holding part in the hair cutting device according to the second exemplary embodiment.

For example, bar 101 may not be bent and may be straight as shown in FIG. 8. Agent holding parts 102 may be dispersively disposed at first face 111 of one bar 101. Agent holding part 102 may have a semicircular section.

Figure 9:
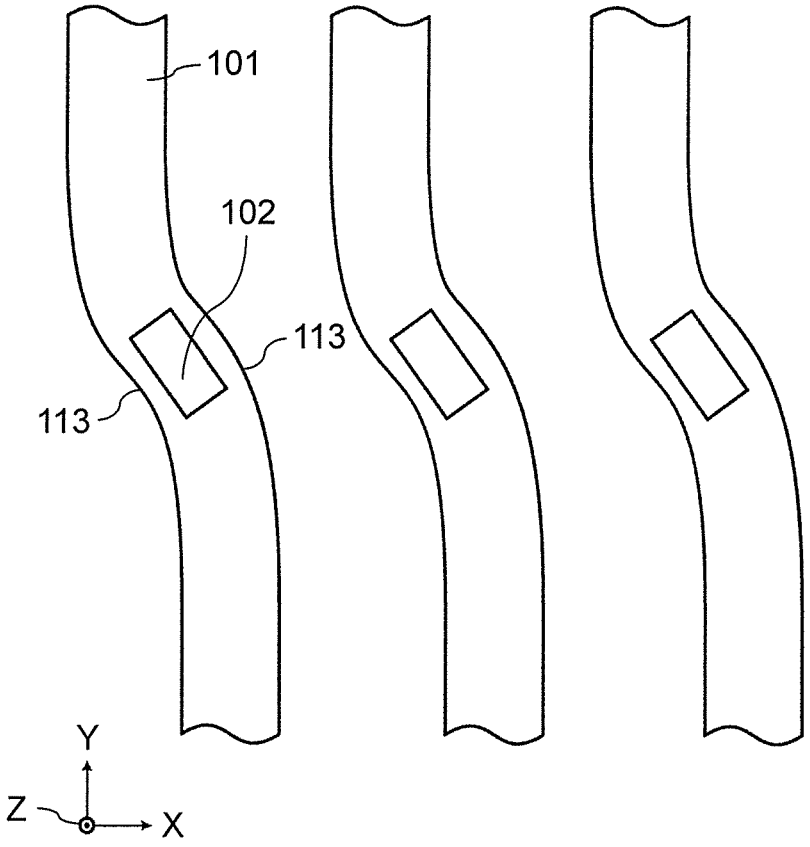
FIG. 9 is a plan view illustrating still another example of the agent holding part in the hair cutting device according to the second exemplary embodiment.

As shown in FIG. 9, agent holding part 102 may have a rectangular shape in an X-Y plane, instead of having a cranked shape or a circular shape that runs along bar 101.

Agent holding part 102 may be disposed only between the adjacent bends.

While an opening edge of agent holding part 102 is illustrated as being sharp, agent holding part 102 may have a rounded opening edge by undergoing, for example, press working, blasting, or surface polishing. Bar 101 thus slides satisfactorily on skin surface 410, and irritation can be suppressed even when outer blade 100 is pressed against skin surface 410.

Bars 101 may be arranged radially instead of being arranged in parallel relationship. A hair shaving method of hair cutting device 200 is not limited. Types of the method that can be given as examples include the reciprocating type, the rotating type, and the rotary type, and bar arrangement and a bar shape may be adopted accordingly for outer blade 100.

While edges 113 are described as being sharp parts in the figures, edges that are rounded to some extent are also included as edges 113.

(Example of Outer Blade for Hair Cutting Device and Example of Hair Cutting Device)

The hair-cutting-device outer blade included in the present disclosure is mounted to the end of the main body of the hair cutting device. The outer blade includes the bars that each have the shape of the rectangular stick and are arranged at the predetermined intervals, and the agent holding part capable of holding the agent that is the substance having the predetermined effect on a skin surface, the agent holding part being the surrounded recess heading from the skin-surface-contact-side first face of each of the bars toward the inner-blade-side second face of each of the bars.

Thus, the agent such as foam or gel can be held by the agent holding part at the skin-surface-side face of the outer blade, and friction can be reduced between the outer blade and the skin surface by the agent that is held by the agent holding part. Also, an area of surface contact is reduced between the outer blade and skin because of the recess-shaped agent holding parts. As such, the friction is reduced during hair treatment, whereby a burden on the skin can be decreased.

The agent holding part may be shaped to extend longitudinally of the bar.

By being grooved-shaped along the bar, the surrounded agent holding part can hold an increased amount of agent. Accordingly, the burden on the skin can be further decreased.

In parallel relationship with the first face, the agent holding part may have a sectional area of the second face side smaller than a sectional area of the first face side.

The agent holding part thus opens widely at its skin surface side while having tight space in its deeper portion of the second face side, so that the bar can maintain its structural strength with the area of surface contact between the outer blade and the skin being suppressed and with the holding amount of agent being ensured.

The outer blade may further include the agent filled into the agent holding part.

With the solid agent or the like that dissolves in water held by the agent holding part, the friction with the skin surface can be suppressed without application of the agent to the skin, and the burden on the skin can be decreased.

The first face of the bar may gradually slope toward the second face, heading from the intermediate part to each of the edges along its width direction, and the agent holding part may be disposed in the intermediate part.

The first face is thus protrusive toward the skin surface. Accordingly, the first face makes smooth contact with the skin surface, and consequently, the burden on the skin can be decreased. Moreover, the agent holding part is disposed about an apex of the projection, so that the friction can be reduced between the outer blade and the skin surface by the agent held by the agent holding part.

The bar may have a cranked shape and may include two or more bends, and the agent holding part may be disposed between the adjacent bends.

The agent holding parts are thus disposed to cross a direction in which the outer blade is moved, so that effective friction reduction can be achieved by the agent.

The hair cutting device included in the present disclosure includes the above-described outer blade, the inner blade moves relatively to the outer blade, the inner blade being disposed inwardly of the outer blade, and the main body that holds the outer blade and the inner blade. As such, effective hair shaving can be achieved with an enhanced hair raising effect while the skin is treated gently.

The hair cutting device may further include the second outer blade that is thinner than the outer blade.

With the friction reduction effect caused by the agent that is held by the agent holding part, the outer blade and the second outer blade can be moved smoothly on the skin, and after the outer blade cuts long hair, the second outer blade can cut the hair even shorter for deep shaving.

The outer blade may be interposed among the plurality of the second outer blades.

Thus, even in cases where the outer blade is reciprocated on the skin, a similar deep shaving effect can be obtained in either direction.

The present disclosure can be used for an outer blade that is used in a hair cutting device for shaving hair such as a beard and head hair, and also can be used for a hair cutting device including the outer blade.

What is claimed is:

1. An outer blade for a hair cutting device, the outer blade being mounted to an end of a main body of the hair cutting device, the outer blade comprising:

bars arranged at predetermined intervals, each of the bars having a first face that makes contact with a skin surface of a user and a second face facing an inner blade of the hair cutting device; and an agent holding part, the agent holding part being a surrounded recess that is recessed from the first face to the second face of each of the bars, wherein at least part of the first face slopes toward the second face, heading from an intermediate part of the first face to each of two edges of the first face along a width direction of the first face, a distance between the two edges along the width direction is larger than a width of the second face, the distance between the two edges and the width of the second face being measured at a location where the first face slopes and at a same location along a length direction of a given bar, and the agent holding part is disposed in the intermediate part.

2. The outer blade according to claim 1, wherein the agent holding part extends longitudinally of each of the bars to follow the shape of each of the bars.

3. The outer blade according to claim 1, wherein the agent holding part has an area of the second face side smaller than an area of the first face side in a plane perpendicular to a depth direction of the agent holding part.

4. The outer blade according to claim 1, further comprising an agent filled into the agent holding part.

5. The outer blade according to claim 1, wherein each of the bars has a cranked shape and includes two or more bends, and the agent holding part is disposed between the bends that are adjacent to each other.

6. A hair cutting device comprising:

the outer blade according to claim 1;

an inner blade that moves relatively to the outer blade, the inner blade being disposed inwardly of the outer blade; and a main body that holds the outer blade and the inner blade.

7. The hair cutting device according to claim 6, further comprising a second outer blade that is thinner than the outer blade.

8. The hair cutting device according to claim 6, wherein the outer blade is interposed among a plurality of the second outer blades.

* * * * *